US010792823B2

(12) United States Patent
Busse

(10) Patent No.: US 10,792,823 B2
(45) Date of Patent: Oct. 6, 2020

(54) LOCKING FOLDING KNIFE AND KNIFE LOCK MECHANISM

(71) Applicant: Jerry P. Busse, Wauseon, OH (US)

(72) Inventor: Jerry P. Busse, Wauseon, OH (US)

( * ) Notice: Subject to any disclaimer, the term of this patent is extended or adjusted under 35 U.S.C. 154(b) by 0 days.

(21) Appl. No.: 16/229,660

(22) Filed: Dec. 21, 2018

(65) Prior Publication Data

US 2019/0381678 A1 Dec. 19, 2019

Related U.S. Application Data

(63) Continuation of application No. 15/171,856, filed on Jun. 2, 2016, now Pat. No. 10,160,122.

(60) Provisional application No. 62/169,581, filed on Jun. 2, 2015.

(51) Int. Cl.
*B26B 1/04* (2006.01)

(52) U.S. Cl.
CPC ..... *B26B 1/048* (2013.01)

(58) Field of Classification Search
CPC ..... B26B 1/048; B26B 1/04
USPC ..... 30/159, 161, 153, 160, 162, 158, 155; D8/98–100
See application file for complete search history.

(56) References Cited

U.S. PATENT DOCUMENTS

| | | | | |
|---|---|---|---|---|
| 6,751,868 | B2 * | 6/2004 | Glesser | B26B 1/048 30/160 |
| 7,059,053 | B2 * | 6/2006 | Sakai | B26B 1/048 30/160 |
| 7,340,837 | B1 * | 3/2008 | Busse | B26B 1/048 30/153 |
| 2004/0154169 | A1 * | 8/2004 | McCann | B26B 1/048 30/161 |

* cited by examiner

*Primary Examiner* — Ghassem Alie
(74) *Attorney, Agent, or Firm* — Benesch, Friedlander, Coplan & Aronoff LLP

(57) ABSTRACT

Various embodiments of a folding knife are disclosed. In one embodiment, a folding knife is provided that has a handle having a slot having at least one top surface and a blade pivotably connected to the handle, wherein the blade has a tang having a contoured peripheral surface and an open block engagement tang surface, wherein the blade has an axis of rotation. The blade further has a locking block translatable on a plane orthogonal to the axis of rotation of the blade, wherein the locking block has an engagement surface positioned to contact at least one of the contoured peripheral surface and the open block engagement tang surface when the blade is in an open position, and wherein the locking block has at least two bearing surfaces engaging the at least one top surface along two lines.

10 Claims, 7 Drawing Sheets

LOCKING FOLDING KNIFE AND KNIFE LOCK MECHANISM

CROSS-REFERENCE TO RELATED APPLICATIONS

This application is a continuation of U.S. Non-provisional patent application Ser. No. 15/171,856, filed on Jun. 2, 2016, which issued as U.S. Pat. No. 10,160,122 on Dec. 25, 2018, and which claims priority from U.S. Provisional Patent Application No. 62/169,581, filed on Jun. 2, 2015, each of which is incorporated by reference herein in its entirety.

BACKGROUND

Folding knives often have a lock mechanism to prevent closing of the knife unless the lock mechanism is actuated by a user of the knife. The strength of the lock mechanism is often very important, as a user may use the knife to pry, which may place a large moment upon the blade, resulting in a large force applied to the lock mechanism. If the lock mechanism fails, or otherwise releases, the knife blade may close and contact the user's body, resulting in a potentially severe injury.

Many knife lock mechanisms are designed for two-handed deactivation. That is, a user must use two hands to actually deactivate the lock and close the knife. Many users prefer a knife lock mechanism that allows convenient one-handed deactivation. However, knife lock mechanisms designed to permit one-handed deactivation may have less strength than other knife lock mechanisms, including those designed for two-handed deactivation.

What is needed is an improved knife lock mechanism with increased strength.

SUMMARY

In one embodiment, a folding knife is provided, the folding knife comprising: a handle, wherein the handle includes a slot having at least one top surface; a blade pivotably connected to the handle, wherein the blade has a tang, the tang including a contoured peripheral surface and an open block engagement tang surface, wherein the blade has an axis of rotation; a locking block, the locking block translatable on a plane orthogonal to the axis of rotation of the blade, wherein the locking block has an engagement surface positioned to contact at least one of the contoured peripheral surface and the open block engagement tang surface of the tang when the blade is in an open position, wherein the locking block has at least two bearing surfaces engaging the at least one top surface of the slot along two lines, the at least two bearing surfaces positioned so that a force applied by the blade to the engagement surface of the locking block is directed along a line between the at least two bearing surfaces.

In another embodiment, a folding knife is provided, the folding knife comprising: a handle, wherein the handle includes a slot having at least one top surface; a blade pivotably connected to the handle, wherein the blade has a tang, the tang including a contoured peripheral surface and an open block engagement tang surface, wherein the open block engagement tang surface has a rounded profile, wherein the blade has an axis of rotation; a locking block, the locking block translatable on a plane orthogonal to the axis of rotation of the blade, wherein the locking block has a planar engagement surface positioned to contact at least one of the contoured peripheral surface and the open block engagement tang surface of the tang when the blade is in an open position, wherein the locking block has at least two bearing surfaces engaging the at least one top surface of the slot along two lines, the at least two bearing surfaces positioned so that a force applied by the blade to the engagement surface of the locking block is directed along a line between the at least two bearing surfaces.

BRIEF DESCRIPTION OF THE DRAWINGS

The accompanying figures, which are incorporated in and constitute a part of the specification, illustrate various example configurations, and are used merely to illustrate various example embodiments. In the figures, like elements bear like reference numerals.

DETAILED DESCRIPTION

The locking folding knives disclosed herein, as well as one or more of the various features thereof, may be an improvement on that shown in U.S. Pat. Nos. 7,032,315, 7,340,837, and 7,578,064, the disclosure of each of which is incorporated herein in its entirety.

Figure 1:
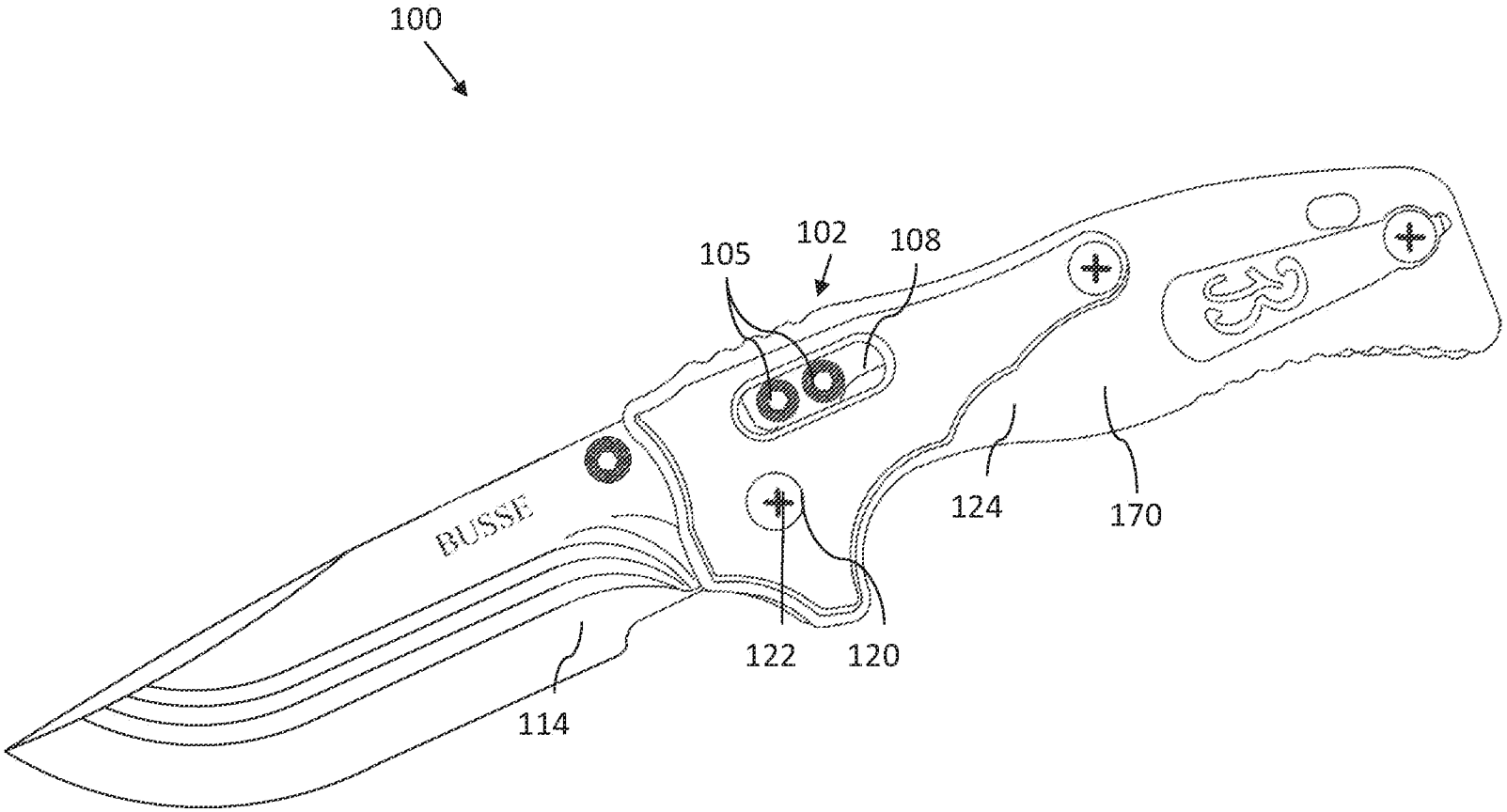
FIG. 1 illustrates an elevational view of an example embodiment of a locking folding knife 100 having a knife lock mechanism 102.

FIG. 1 illustrates a locking folding knife 100 having a knife lock mechanism 102. Lock mechanism 102 may include at least one protrusion 105. Knife 100 may include at least one handle 124. In one embodiment, knife 100 includes two handles 124 oriented on opposite sides of knife 100. At least a portion of at least one protrusion 105 may extend through at least one slot 108 in a handle 124. Alternatively, slot 108 may be oriented in a frame (not shown) of knife 100. Alternatively, slot 108 may be oriented in at least one panel 170 attached to handle 124. Alternatively, slot 108 may be oriented in at least two of handle 124, a frame (not shown), and at least one panel 170.

Knife 100 may include a blade 114. Blade 114 may be pivotably connected to handle 124. Blade 114 may be connected to handle 124 via an axle 120. Axle 120 may have a central axis 122 about which blade 114 may rotate. Blade 114 may rotate on axle 120. Blade 114 rotate with axle 120. Central axis 122 may be a fixed axis. Blade 114 may fold about 180 degrees from the position illustrated in FIG. 1 and may extend at least partially into a space in handle 124, between two handles 124, a space in a frame (not shown), and the like. Handle 124 may include at least one panel 170. At least one panel 170 may be removable. Handle 124 may include two panels 170 on either side of handle 124 and the two panels 170 may be mirrored versions of one another.

Figure 2A:
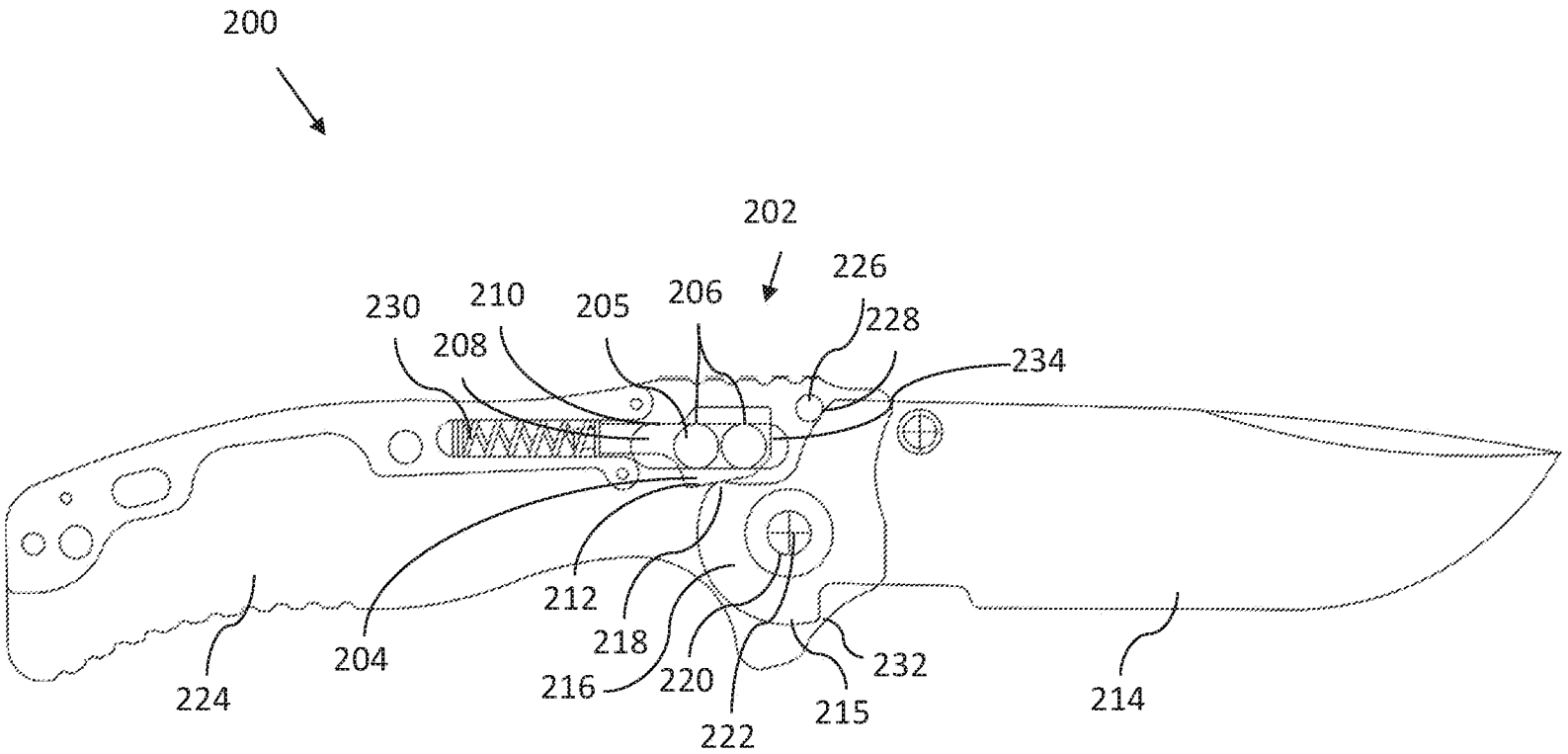
FIG. 2A illustrates a cutaway elevational view of an example embodiment of a locking folding knife 200 having a knife lock mechanism 202 in an open orientation.
Figure 2B:
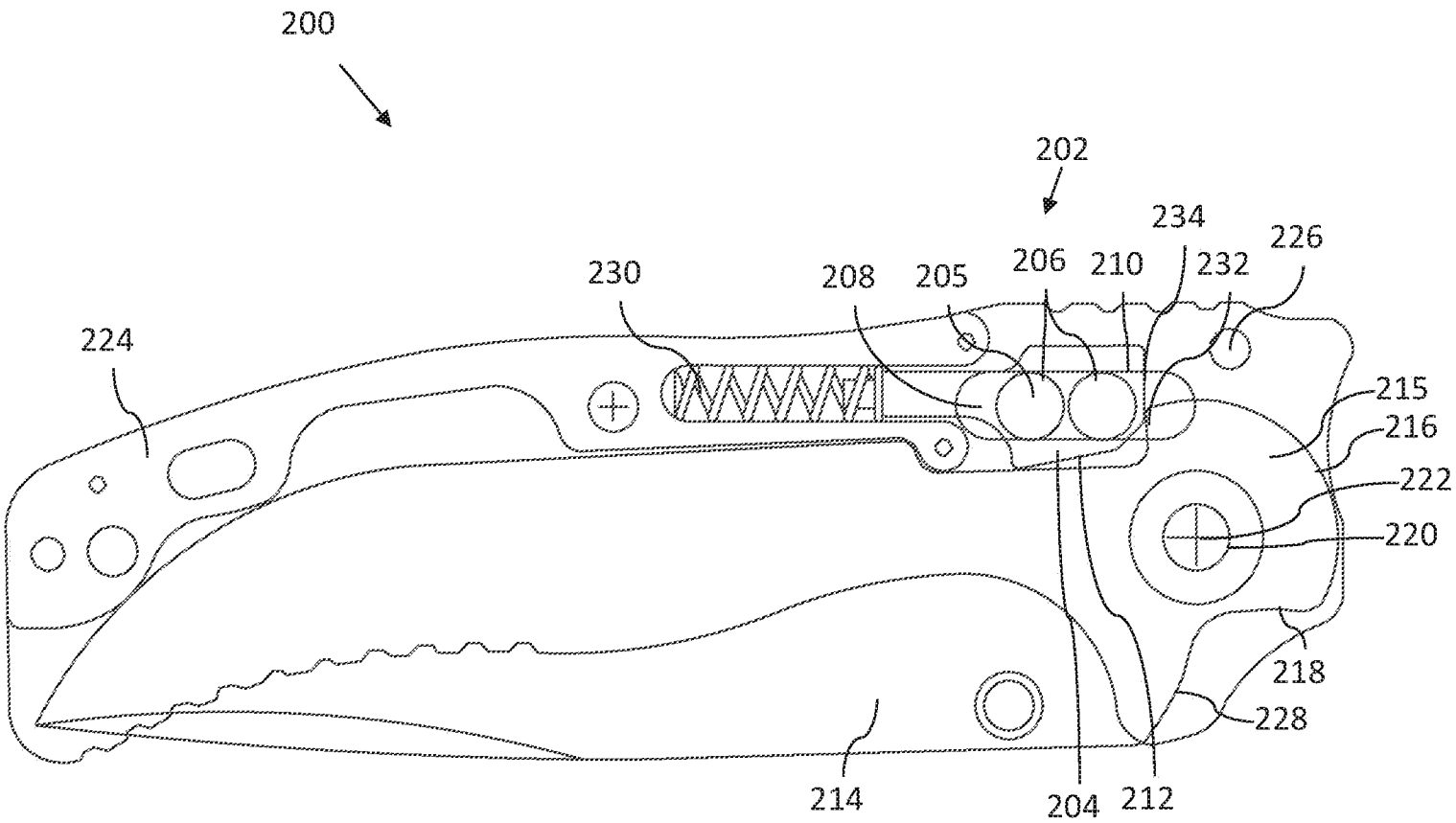
FIG. 2B illustrates a cutaway elevational view of an example embodiment of locking folding knife 200 having knife lock mechanism 202 in a closed orientation.
Figure 2C:
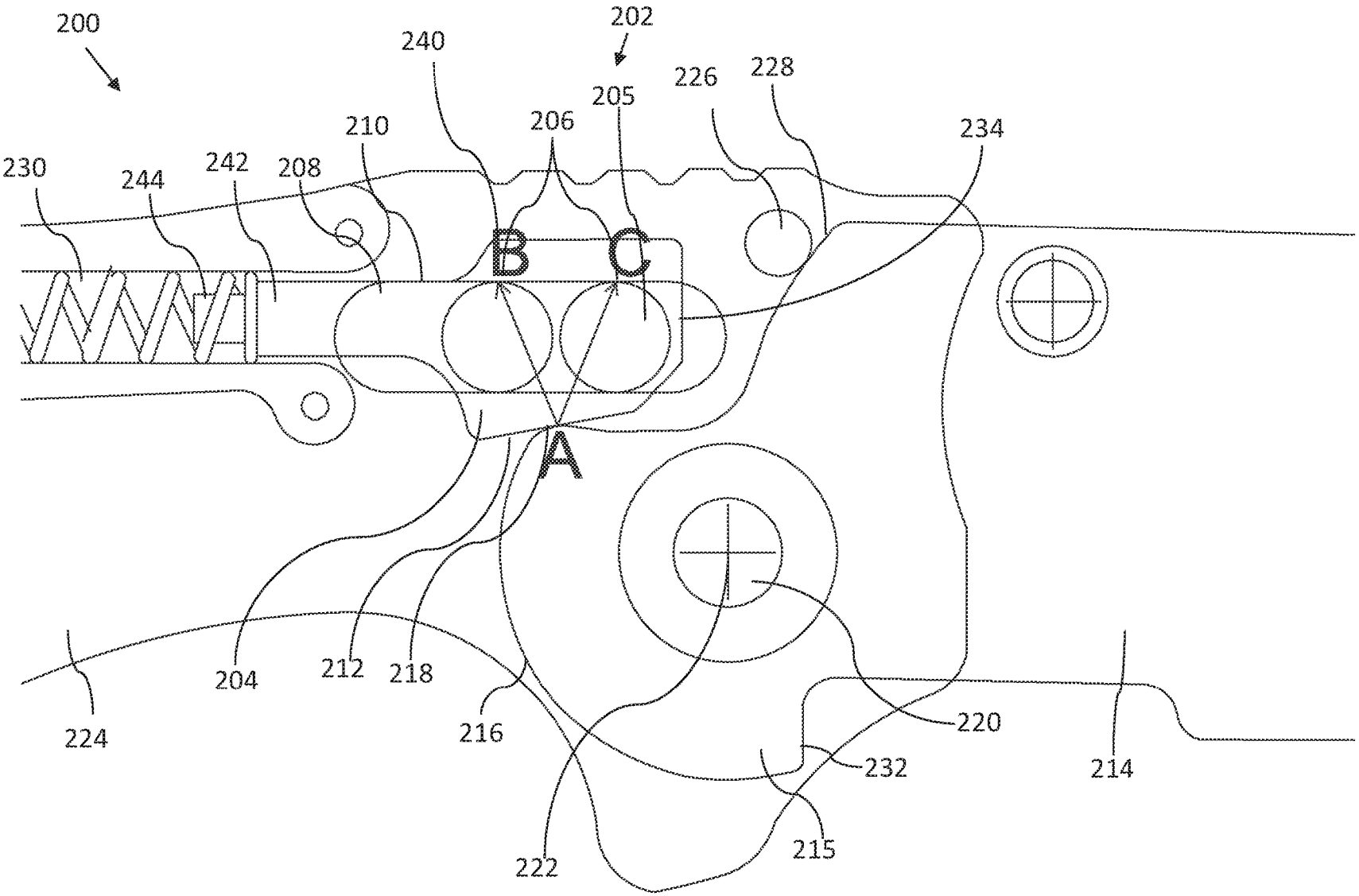
FIG. 2C illustrates an enlarged cutaway elevational view of an example embodiment of locking folding knife 200 having knife lock mechanism 202 in an open orientation.

FIGS. 2A-2C illustrate a locking folding knife 200 having a knife lock mechanism 202 in various orientations.

Lock mechanism 202 may include a locking block 204. Locking block 204 may include at least one protrusion 205. Locking block 204 may include two protrusions 205, with two extending completely across the width of locking block 204. Locking block 204 may include four protrusions 205, with two on either side of locking block 204. Each protrusion may include a rounded or curvilinear upper bearing surface 206. Where locking block 204 includes two protrusions 205, locking block 204 may include two upper bearing surfaces. Where locking block 204 includes four protrusions 205, locking block 204 may include four upper bearing surfaces. Protrusion 205 may be any of a variety of shapes, including for example a cylinder, an ellipse, an oval, an irregular shape, and the like.

Locking block 204 may include a lower engagement surface 212. Lower engagement surface 212 may be substantially linear. Lower engagement surface 212 may be curvilinear. Lower engagement surface 212 may be angled. Lower engagement surface 212 may be angled, like a ramp. Lower engagement surface 212 may be angled, resulting in at least a partial wedge shape. Lower engagement surface 212 may be any of a variety of shapes.

Knife 200 may include a handle 224. Handle 224 may include a slot 208. Slot 208 may be substantially linear. At least a portion of protrusion 205 may extend through slot 208.

In one embodiment, handle 224 has two slots 208, one on each side of knife 200. Locking block 204 may include a plurality of protrusions 205, oriented on each side of knife 200. Each protrusion 205 may extend through each slot 208 on respective sides of knife 200.

Slot 208 may include at least one slot 208. Slot 208 may be an elongated slot. Slot 208 may be oriented generally forward and backward on knife 200. Each slot 208 may include a top surface 210. Upper bearing surface 206 of locking block 204 may at least partially engage top surface 210. Where knife 200 includes two slots 208, and thus two top surfaces 210, two upper bearing surfaces 206 on either side of locking block 204 may contact each top surface 210. Upper beating surface 206 may engage top surface 210. Upper bearing surface 206 may be configured to engage top surface 210 substantially normally. Upper bearing surface 206 may be configured to engage top surface 210 at an angle of about 90 degrees relative to top surface 210. Upper bearing surface 206 may be configured to engage top surface 210 at an angle of less than about 90 degrees relative to top surface 210. Upper bearing surface 206 may be configured to engage top surface 210 at an angle of greater than about 90 degrees relative to top surface 210. Protrusion 205 may engage the surfaces of slot 208. Protrusion 205 may slidably engage the surfaces of slot 208.

Upper bearing surface 206 may be configured to translate relative to top surface 210 during engagement and/or disengagement of lock mechanism 202. Upper bearing surface 206 may be configured to slide along top surface 210 during engagement and/or disengagement of lock mechanism 202. Top surface 210 may be a support surface for locking block 204.

Knife 200 may include a blade 214. Blade 214 may be pivotably connected to handle 224. Blade 214 may be pivotably connected to handle 224 via an axle 220. Axle 220 may include a central axis 222. Blade 214 may rotate about central axis 222.

Blade 214 may include a tang 215. Tang 215 may include an aperture (not shown) through which axle 220 passes. Tang 215 may include a contoured peripheral surface 216. Contoured peripheral surface 216 may contact locking block 204 during opening and closing of blade 214. Tang 215 and/or contoured peripheral surface 216 may include an open block engagement tang surface 218.

Locking block 204 may translate toward and away from the front of knife 200, defined as that end of knife 200 where axle 220 is located when blade 214 is closed. Stated differently, the front of knife 200 is defined as that end of knife 200 where the tip of blade 214 is oriented when blade 214 is open. Locking block 204 may translate in a plane that is orthogonal to central axis 222 and orthogonal to the axis of rotation of blade 214. Central axis 222 may be the axis of rotation of blade 214.

Locking block 204 may be biased toward the front of knife 200 by a biasing device 230. Locking block 204 may be biased into engagement with blade 214 via biasing device 230, Biasing device 230 may include any of a variety of devices configured to bias locking block 204 toward the front of knife 200. Biasing device 230 may include a spring, a piston, an actuator, an elastomeric device, and the like. Biasing device 230 may be configured to operate in compression, including for example a compression spring. Biasing device 230 may be configured to operate in tension, including for example a tension band. Biasing device 230 may be configured to operate in torsion, including for example a torsion spring.

Surface 218 may be configured to engage engagement surface 212, thus locking blade 214 in an open position relative to handle 224. Locking block 204 may engage surface 218 and lock blade in an open position when locking block 204 is oriented toward axle 220. Locking block 204 may be biased toward the front of knife 200, and may prevent surface 218 from rotating (e.g., clockwise in FIG. 2), and thus may prevent tang 215 from rotating, and thus may prevent blade 214 from rotating to a closed position.

In one embodiment, engagement surface 212 contacts surface 218. Engagement surface 212 may be generally planar, while surface 218 may have a rounded profile. As a result there is substantially line contact between tang 215 and locking block 204 when blade 214 is in the open position with locking block 204 advanced to lock blade 214 in the open position. Locking block 204 may be guided in its sliding movement by one or more bearing surface 206. For example, knife 200 may include two bearing surfaces 206, with one bearing surface 206 forward and the other bearing surface 206 rearward on knife 200. Bearing surfaces 206 may press against top surface 210 of slot 208. Top surface 210 may be generally flat, and bearing surfaces 206 may be generally rounded, so that there is substantially line contact between bearing surfaces 206 and top surface 210. The lines of contact between bearing surfaces 206 and top surface 210, and between surface 218 of tang 215 and engagement surface 212 of locking block 204 may be generally parallel with each other, and may be positioned so that force applied by tang 215 to locking block 204 acts on a line that extends between the two bearing surface lines of contact with top surface 210.

Contoured peripheral surface 216 and surface 218 of tang 215 may be curved continuously, and accordingly when surface 218 contacts engagement surface 212 of locking block 204, there is substantially line contact between locking block 204 and tang 215.

Protrusions 205 may include axially outer portions that are configured to be gripped by a user to allow retraction of locking block 204. Bearing surfaces 206 of protrusions 205 may be any shape, as long as the shape results in substantially line contact with top surface 210 of slot 208, as discussed above. Alternatively, bearing surfaces 206 could be rounded about two axes, being possibly spherical or ovoid. The resulting contact between bearing surfaces 206 and top surface 210 would then be substantially point contact. Bearing surface 206 may comprise any shape that does not produce substantially plane to plane contact.

Tang 215 may include a blade stop engagement surface 228. As illustrated in FIGS. 2A and 2C, blade stop engagement surface 228 may contact a blade stop 226. Blade stop 226 may be attached to handle 224. Blade stop 226 may be attached to a frame (not shown). Engagement between blade stop engagement surface 228 and blade stop 226 may limit blade 214 from opening further than necessary.

Tang 215 may include a blade closed retention surface 232. Locking block 204 may include a front surface 234. As illustrated in FIG. 2B, blade closed retention surface 232 may engage front surface 234 when blade 214 is in a closed position. Engagement of blade closed retention surface 232 with front surface 234 may bias blade 214 into a closed position until a user opens blade 214 at least part way (e.g., counterclockwise in FIG. 2B) until blade closed retention surface 232 and front surface 234 come out of contact with one another.

With specific reference to FIG. 2C, locking block 204 may include a dorsal portion 240. Dorsal portion 240 may be configured to help maintain locking block 204 within handle 224, such that locking block 204 cannot move laterally relative to handle 224, which is axial relative to axle 220. Dorsal portion 240 may fit within a space in handle 224 to at least partially prevent lateral, side to side motion of locking block 204.

Locking block 204 may include a stem portion 242, which may extend generally from protrusions 205 to biasing device 230. Stem portion 242 may include a biasing device engagement portion 244, which may include a short protrusion from stem portion 242 configured to extend within or about biasing device 230.

With specific reference to FIG. 2C, as discussed above, there may be line contact between open block engagement tang surface 218 of tang 215 and engagement surface 212. This line contact may extend through a point A along a line perpendicular to the plane of FIG. 2C. Similarly there may be a line contact between bearing surfaces 206 and top surface 210 of slot 208 which may be imagined as lines extending perpendicular to the plane of FIG. 2C at points B and C. Surface 218 of tang 215 may be shaped and proportioned to cooperate with engagement surface 212 on the bottom side of locking block 204 in a manner that produces a resultant force which acts along a line between the lines of contact B and C. This arrangement may stabilize locking block 204 against rocking movement in the fore and aft (forward and backward) direction relative to knife 200, and thus may help ensure the stability of the blade.

Viewed lengthwise, locking block 204 may be supported by spaced apart contact with top surface 210 of slot 208 formed in the two panels (the front panel and the rear panel, not shown) of handle 224, and/or slot 208 formed in handle 224, while force from tang 215 may be transmitted to engagement surface 212 of locking block 204, which may be between the two panels making up handle 224, or otherwise contained within handle 224. Any tendency of locking block 204 to rock side to side may thus be countered by the spaced apart support of top surfaces 210 of slots 208 in the side panels (not shown) or otherwise contained within handle 224. With this in mind, it can be seen that side to side stability may be achieved even if bearing surfaces 206 are planar and have plane-to-plane contact with top surfaces 210 of slots 208, rather than the preferred point or line contact with those surfaces.

Engagement surface 212 on the lower face of locking block 204 may be inclined with respect to top surface 210 of slot 208. This incline may permit locking block 204 to be withdrawn manually from its locking position, but may be near enough to parallel with top surface 210 so that force applied through tang 215 cannot push locking block 215 rearward.

Where handle 224 includes a first panel and a second panel (not shown), the panels may be separated by a spacer (not shown) which is slightly thicker than the main body of locking block 204. This may allow locking block 204 to slide freely forward and aft in slot 208. Alternatively, handle 224 may comprise a space (not shown) that is slightly thicker than the main body of locking block 204, such that locking block 204 may slide freely forward and aft in slot 208.

Figure 3A:
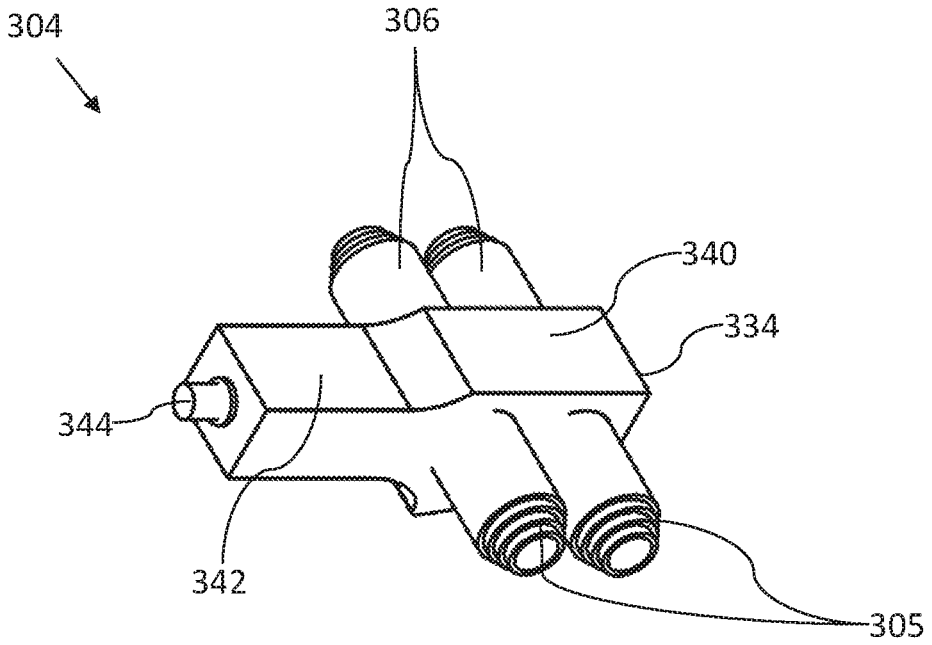
FIG. 3A illustrates a top perspective view of an example embodiment of knife locking block 304.
Figure 3B:
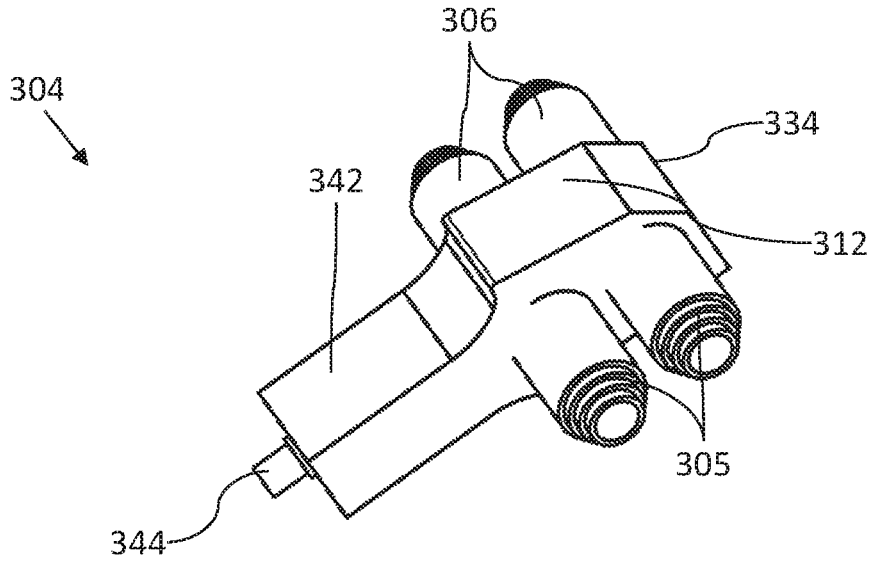
FIG. 3B illustrates a bottom perspective view of an example embodiment of knife locking block 304.

FIGS. 3A and 3B illustrate an example embodiment of knife locking block 304. Locking block 304 may be substantially similar to locking block 104 and 204 discussed above. Locking block 304 may include at least one protrusion 305. At least one protrusion 305 may include a bearing surface 306 configured to engage a slot (not shown) on a knife (not shown). Locking block 304 may include an engagement surface 312.

Locking block 304 may include a front surface 334. Locking block 304 may include a dorsal portion 340. Locking block 304 may be substantially elongated, and may include a stem portion 342. Stem portion 342 may include a biasing device engagement portion 344.

As illustrated, locking block 304 may include four protrusions 305, each including a bearing surface 306, for a total of four bearing surfaces 306. A knife (not shown) incorporating locking block 304 may include two slots (not shown), each having a top surface (not shown), wherein two bearing surfaces 306 on a first side of locking block 304 engage a first slot, and two bearing surfaces 306 on a second side of locking block 304 engage a second slot.

Figure 4:
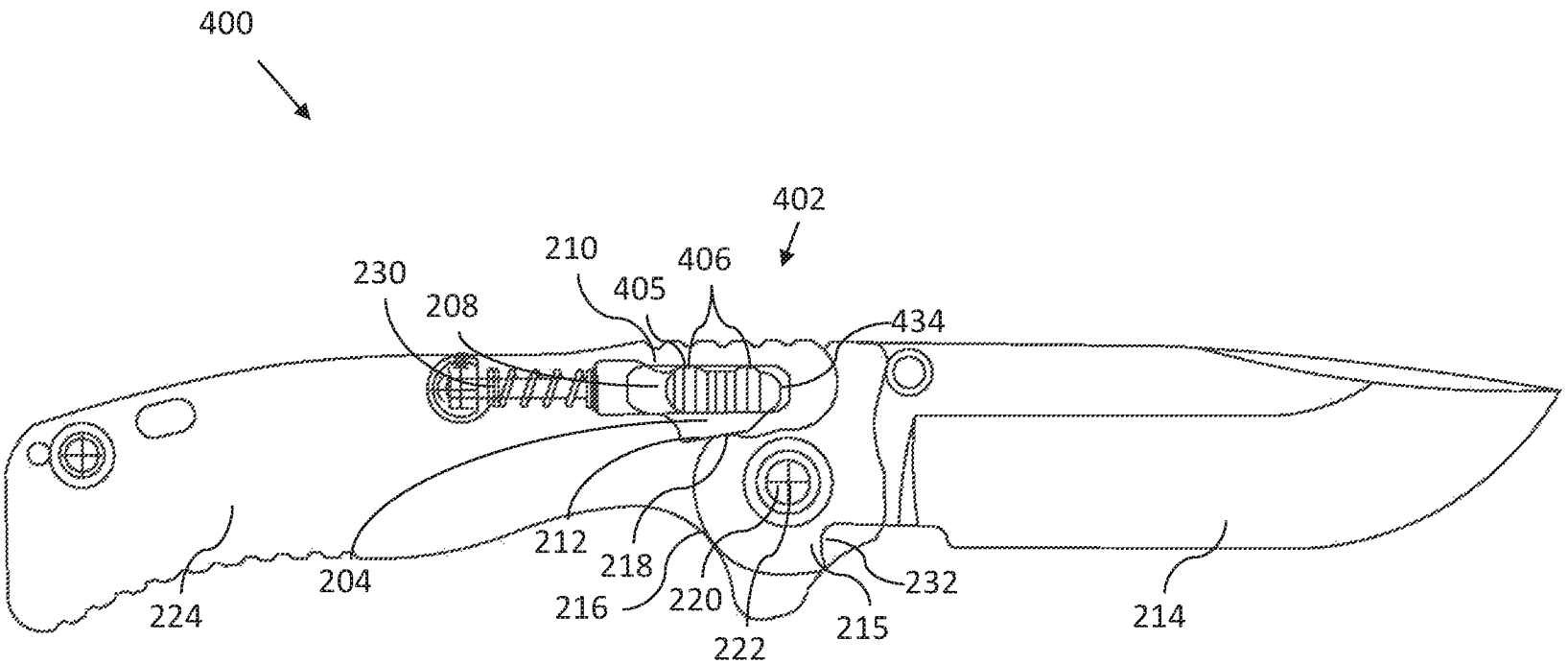
FIG. 4 illustrates a partially cutaway elevational view of an example embodiment of a locking folding knife 400 having a knife lock mechanism 402.

FIG. 4 illustrates a partially cutaway elevational view of an example embodiment of a locking folding knife 400 having a knife lock mechanism 402. Knife 400 may be substantially similar to knife 200, with the exception of an alternative lock mechanism 402. Like reference numerals between FIG. 2 and FIG. 4 are understood to refer to the same elements.

Lock mechanism 402 may include a locking block 404. Locking block 404 may include a protrusion 405. Protrusion 405 may include knurling, textures, scalloping, or otherwise treated surface to allow a user to actuate locking block 404.

Locking block 404 may include at least one bearing surface 406, which may be sized and shaped similar to bearing surface 206 discussed above. Bearing surface 406 may engage a top surface 210 of slot 208.

Locking block 404 may include a front surface 434. Front surface 434 may be substantially similar to front surface 234 discussed above.

Figure 5B:
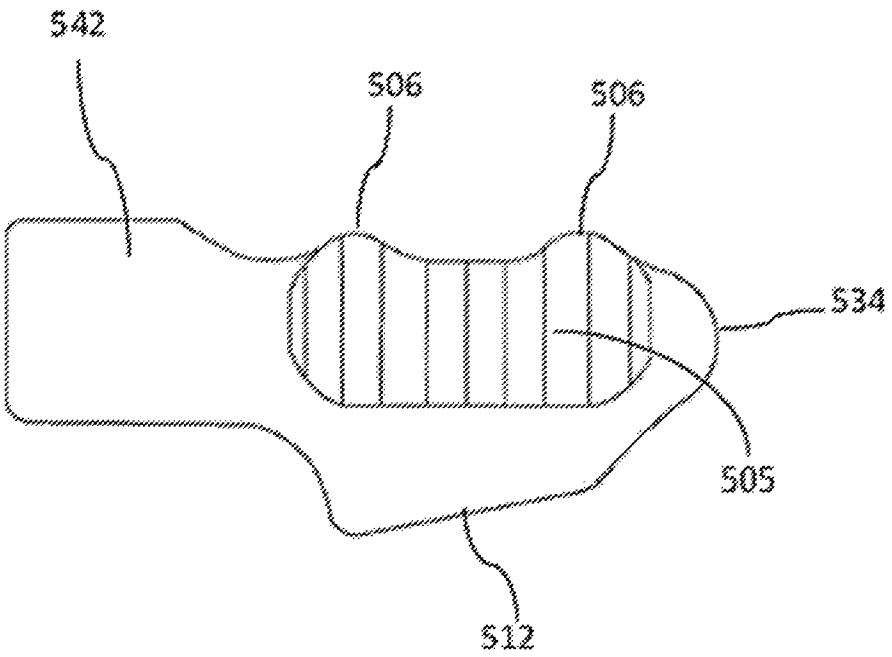
FIG. 5B illustrates an elevational view of an example embodiment of knife locking block 504.
Figure 5A:
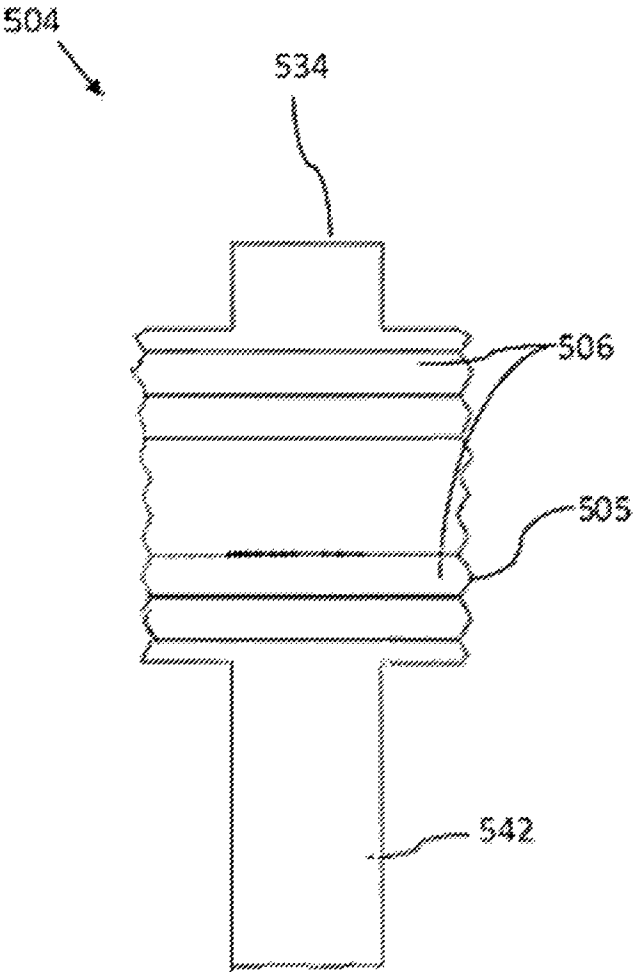
FIG. 5A illustrates a top plan view of an example embodiment of a knife locking block 504.

FIGS. 5A and 5B illustrate an example embodiment of a knife locking block 504. Locking block 504 may be substantially similar to locking block 404, Locking block 504 may include at least one protrusion 505. Locking block 504 may include at least one bearing surface 506. Locking block 504 may include a lower engagement surface 512. Locking block 504 may include a front surface 534. Locking block 504 may include a stem 542. Stem 542 may be configured to engage a biasing device (not shown).

Some prior art knife designs may include a tang having a generally flat locking surface that is part of the tang's peripheral edge. These designs may include a round locking pin that is configured to move fore and aft on the knife, and which may engage the flat locking surface to lock the knife blade in an open orientation. This configuration suffers from numerous drawbacks, not the least of which is inconsistent positioning of the round locking pin relative to the flat locking surface of the tang due to the natural wear of the pin or the locking surface. This wear may result in the locking pin engaging the flat locking surface farther forward (closer to the front of the knife), which may result in increased forces on the locking pin and/or flat locking surface due to reduction in the length of the "lever arm" created by the engagement point being closer to the pivot point of the knife blade. These increased forces on the locking pin and/or flat locking surface may make the locking pin and flat locking surface engagement more prone to failure. Additionally, this wear may result in the locking pin extending farther forward (closer to the front of the knife), which may result in a "jamming" of the pin such that disengagement of the pin to allow the blade to close may require prying of the pin with another object, and obviously does not permit a one-handed disengagement operation by the user. Finally, the use of a single round locking pin will result in a single point of contact between the bearing surface of the pin and the top surface of the slot in which the pin may move.

The improved design disclosed herein, including that described with respect to knives 100, 200, and 400, may include a locking block (e.g., locking block 104, 204, 304, 405, and/or 504) having an angled lower engagement surface (e.g., lower engagement surface 212, 312, 412, and/or 512) that may form a ramp for contacting an open block engagement tang surface (e.g., open block engagement tang surface 218) that includes a curvilinear profile on the rearward portion of the tang (e.g., tang 215). The engagement of open block engagement tang surface 218 with a lower engagement surface 212, 312, 412, and/or 512 may act as a wedge between tang 215 and top surface 210. Open block engagement tang surface 218 having a curvilinear profile may provide a generally vertically directed upward force on lower engagement surface 212, 312, 412, and/or 512 in the event that a downward force is applied to the tip of blade 214. This force direction arrangement may prevent inadvertent closure of blade 214 to the retracted position. In the event that open block engagement tang surface 218 and/or lower engagement surface 212, 312, 412, and/or 512 should wear with use, lower engagement surface 212, 312, 412, and/or 512 would simply ride further forward, under the pressure of biasing device 230, to continue to maintain a secure locking of blade 214 in the extended position. This arrangement may ensure that the engagement between lower engagement surface 212, 312, 412, and/or 512 and open block engagement tang surface 218 is oriented as far rearward on tang 215 as possible, thus maximizing the length of the "lever arm" formed between open block engagement tang surface 218 and the axis of rotation of blade 214 (e.g., central axis 222). In this manner, the force experienced at the engagement between lower engagement surface 212, 312, 412, and/or 512 and open block engagement tang surface 218 may be minimized. Additionally, tang 214 may be engaged consistently at the rearward most portion, thus preventing "jamming" of the locking block and continuously permitting a one-handed disengagement operation.

To the extent that the term "includes" or "including" is used in the specification or the claims, it is intended to be inclusive in a manner similar to the term "comprising" as that term is interpreted when employed as a transitional word in a claim. Furthermore, to the extent that the term "or" is employed (e.g., A or B) it is intended to mean "A or B or both." When the applicants intend to indicate "only A or B but not both" then the term "only A or B but not both" will be employed. Thus, use of the term "or" herein is the inclusive, and not the exclusive use. See Bryan A. Garner, A Dictionary of Modern Legal Usage 624 (2d. Ed. 1995). Also, to the extent that the terms "in" or "into" are used in the specification or the claims, it is intended to additionally mean "on" or "onto." To the extent that the term "substantially" is used in the specification or the claims, it is intended to take into consideration the degree of precision available or prudent in manufacturing. To the extent that the terra "selectively" is used in the specification or the claims, it is intended to refer to a condition of a component wherein a user of the apparatus may activate or deactivate the feature or function of the component as is necessary or desired in use of the apparatus. To the extent that the term "operatively connected" is used in the specification or the claims, it is intended to mean that the identified components are connected in a way to perform a designated function. As used in the specification and the claims, the singular forms "a," "an," and "the" include the plural. Finally, where the term "about" is used in conjunction with a number, it is intended to include ±10% of the number. In other words, "about 10" may mean from 9 to 11.

As stated above, while the present application has been illustrated by the description of embodiments thereof, and while the embodiments have been described in considerable detail, it is not the intention of the applicants to restrict or in any way limit the scope of the appended claims to such detail. Additional advantages and modifications will readily appear to those skilled in the art, having the benefit of the present application. Therefore, the application, in its broader aspects, is not limited to the specific details, illustrative examples shown, or any apparatus referred to. Departures may be made from such details, examples, and apparatuses without departing from the spirit or scope of the general inventive concept.

The invention claimed is:

1. A folding knife, comprising:

a handle, wherein the handle includes a slot having at least one top surface;

a blade pivotably connected to the handle, wherein the blade has a tang, the tang including a contoured peripheral surface and an open block engagement tang surface, wherein the open block engagement tang surface has a rounded profile, wherein the blade has an axis of rotation;

a locking block, the locking block translatable on a plane orthogonal to the axis of rotation of the blade, wherein the locking block has a planar engagement surface positioned to contact at least one of the contoured peripheral surface and the open block engagement tang surface of the tang when the blade is in an open position, wherein the locking block has at least two bearing surfaces engaging the at least one top surface of the slot along two lines, the at least two bearing surfaces positioned so that a force applied by the blade to the engagement surface of the locking block is directed along a line between the at least two bearing surfaces, and wherein the locking block has a valley oriented between each of the at least two bearing surfaces, the valley separating the two bearing surfaces.

2. The folding knife of claim 1, wherein the handle includes a first panel and a second panel oriented on opposite sides of the handle.

3. The folding knife of claim 2, wherein the slot extends through at least one of the first panel and the second panel.

4. The folding knife of claim 1, further comprising a biasing device configured to bias the locking block into engagement with the blade.

5. The folding knife of claim 1, wherein the locking block includes a stem portion and a biasing device engagement portion.

6. The folding knife of claim 5, further comprising a biasing device, wherein the biasing device engages the locking block via the biasing device engagement portion.

7. The folding knife of claim 1, wherein the at least two bearing surfaces have a curvilinear upper surface.

8. The folding knife of claim 1, wherein the engagement surface is angled.

9. The folding knife of claim 1, wherein the locking block includes at least one protrusion.

10. The folding knife of claim 9, wherein the at least two bearing surfaces are oriented on the at least one protrusion.

* * * * *